US006553772B1

(12) United States Patent
Belanger et al.

(10) Patent No.: US 6,553,772 B1
(45) Date of Patent: Apr. 29, 2003

(54) APPARATUS FOR CONTROLLING THE OPERATION OF A CRYOGENIC LIQUEFIER

(75) Inventors: Paul William Belanger, East Amherst, NY (US); William R. Esposito, Amherst, NY (US); Thomas Edward Gajewski, Tonawanda, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/140,826

(22) Filed: May 9, 2002

(51) Int. Cl.[7] ..... F25B 19/02
(52) U.S. Cl. ..... 62/51.2; 62/657
(58) Field of Search ..... 62/51.2, 657

(56) References Cited

U.S. PATENT DOCUMENTS

| | | | | |
|---|---|---|---|---|
| 4,809,154 A | | 2/1989 | Newton | 364/148 |
| 5,119,637 A | * | 6/1992 | Bard et al. | 62/51.2 |
| 5,139,548 A | | 8/1992 | Liu et al. | 62/24 |
| 5,548,963 A | * | 8/1996 | Skertic | 62/51.2 |
| 5,551,244 A | * | 9/1996 | Bailey | 62/51.2 |
| 5,791,160 A | | 8/1998 | Mandler et al. | 62/611 |
| 6,065,305 A | | 5/2000 | Arman et al. | 62/613 |
| 6,076,372 A | | 6/2000 | Acharya et al. | 62/606 |

* cited by examiner

*Primary Examiner*—Ronald Capossela
(74) *Attorney, Agent, or Firm*—Stanley Ktorides

(57) ABSTRACT

A refrigeration system having a partially decentralized operating control system wherein five defined separate controllers control either one or more than one defined variables.

7 Claims, 2 Drawing Sheets

APPARATUS FOR CONTROLLING THE OPERATION OF A CRYOGENIC LIQUEFIER

TECHNICAL FIELD

This invention relates generally to refrigeration systems using a multicomponent refrigerant fluid and is particularly useful for controlling the operation of a cryogenic liquefier.

BACKGROUND ART

The employment of multicomponent refrigerant fluids in the operation of refrigeration systems such as cryogenic liquefiers has recently been receiving increased attention. In any refrigeration system it is important to operate that system in its proper mode in the face of disturbances and numerous control systems for so operating refrigeration systems are known. In the case where the refrigerant fluid for a liquefier is a multicomponent refrigerant fluid it would be highly desirable to have a control system which does not rely on adjusting the refrigerant mixture online as such adjustment requires the addition of equipment that would add capital expense and add to the complexity of the operation.

Accordingly, it is an object of this invention to provide an improved apparatus for controlling the operation of a refrigeration system such as a cryogenic liquefier.

It is another object of this invention to provide an improved apparatus for controlling the operation of a refrigeration system such as a cryogenic liquefier which is particularly useful when the refrigerant fluid employed in the system is a multicomponent refrigerant fluid.

SUMMARY OF THE INVENTION

The above and other objects, which will become apparent to those skilled in the art upon a reading of this disclosure, are attained by the present invention which is:

Apparatus for producing refrigerated product comprising:

(A) a compressor, a surge tank, means for passing refrigerant fluid from the compressor to the surge tank said means including a surge tank inlet valve, and means for passing refrigerant fluid from the surge tank to the compressor said means including a surge tank outlet valve;

(B) a multistage heat exchanger having an initial stage and a final stage, and means for passing refrigerant fluid from the compressor to the heat exchanger said means including an aftercooler having a cooling fluid input valve;

(C) a phase separator having a vapor exit and a liquid exit, means for passing refrigerant fluid from the initial stage of the heat exchanger to the phase separator, and means for passing refrigerant fluid from the liquid exit of the phase separator to the compressor said means including a first Joule-Thomson valve;

(D) means for passing refrigerant fluid from the vapor exit of the phase separator to a second Joule-Thomson valve, from the second Joule-Thomson valve to the final stage of the heat exchanger, and from the final stage of the heat exchanger to the compressor;

(E) means for passing product fluid to the heat exchanger, and means for recovering refrigerated product from the heat exchanger said means including a product valve;

(F) a first controller for regulating the product fluid production rate, said first controller manipulating the compressor;

(G) a second controller for regulating the pressure of refrigerant fluid passed to the compressor, said second controller adjusting the position of the second Joule-Thomson valve;

(H) a third controller for regulating product fluid liquid level, said third controller manipulating the product valve;

(I) a fourth controller for regulating the temperature of the refrigerant fluid downstream of the aftercooler, the temperature of the refrigerant fluid upstream of the first Joule-Thomson valve and the liquid level in the separator, said fourth controller controlling the position of the cooling fluid input valve and also adjusting the position of the first Joule-Thomson valve; and (J) a fifth controller for regulating the pressure of refrigerant fluid discharged from the compressor, said fifth controller adjusting the position of the surge tank inlet valve and also adjusting the position of the surge tank outlet valve.

As used herein the term "controller" means a device that either directly manipulates or causes the manipulation of one or more pieces of plant equipment based on the value of one or more process measurements and the value of other inputs from either an operator or some other device.

As used herein the term "Joule-Thomson valve" means a valve that is used to provide cooling from the expansion of a gas.

As used herein the term "phase separator" means a vessel wherein incoming fluid is separated into individual vapor and liquid fractions, typically by gravity.

Figure 1:
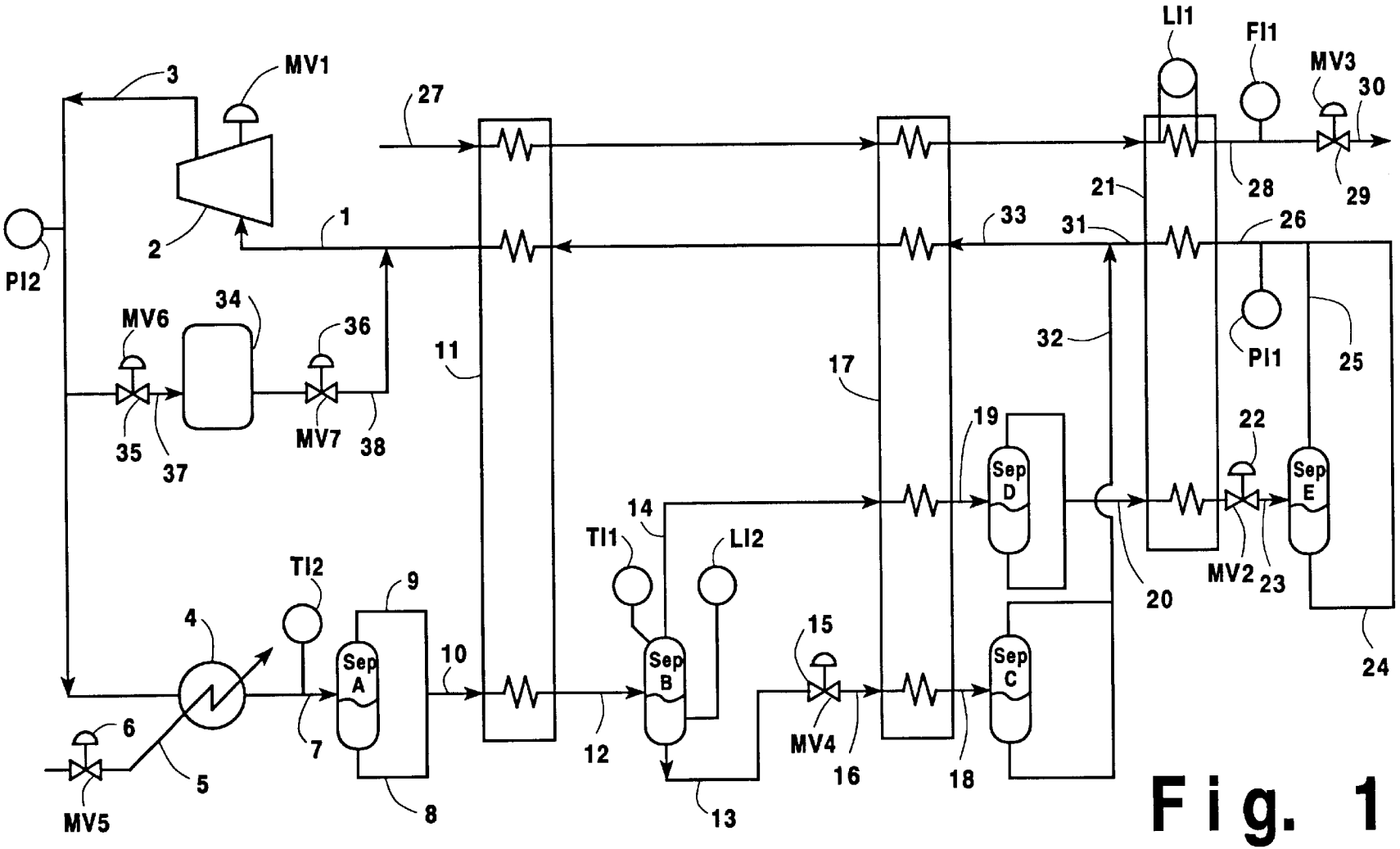
FIG. 1 is a schematic representation of one preferred embodiment of the control system of this invention.

The numerals and symbols used in the Drawings are the same for the common elements.

DETAILED DESCRIPTION

The invention employs a partially decentralized control system. A centralized controller is a controller that takes into account the interaction between all of the variables. It modulates all of the manipulated variables simultaneously based on the present and past values of all controlled variables, usually according to a rule that optimizes the future trajectory of the controlled variables. A fully de-centralized control system uses distinct controllers that act independently of each other. Each controller monitors a single controlled variable and modulates a single manipulated variable. The advantages of a fully centralized control system are that it can usually achieve better control performance because it accounts for interactions and, because of the way the control algorithms are designed, it can provide a more uniform control philosophy for dissimilar processes. The disadvantages of a fully centralized controller are that it can be difficult to tune and maintain and it can also be more expensive to implement. A fully decentralized control system, while much easier to operate, does not provide the performance desirable for top level units.

Figure 2:
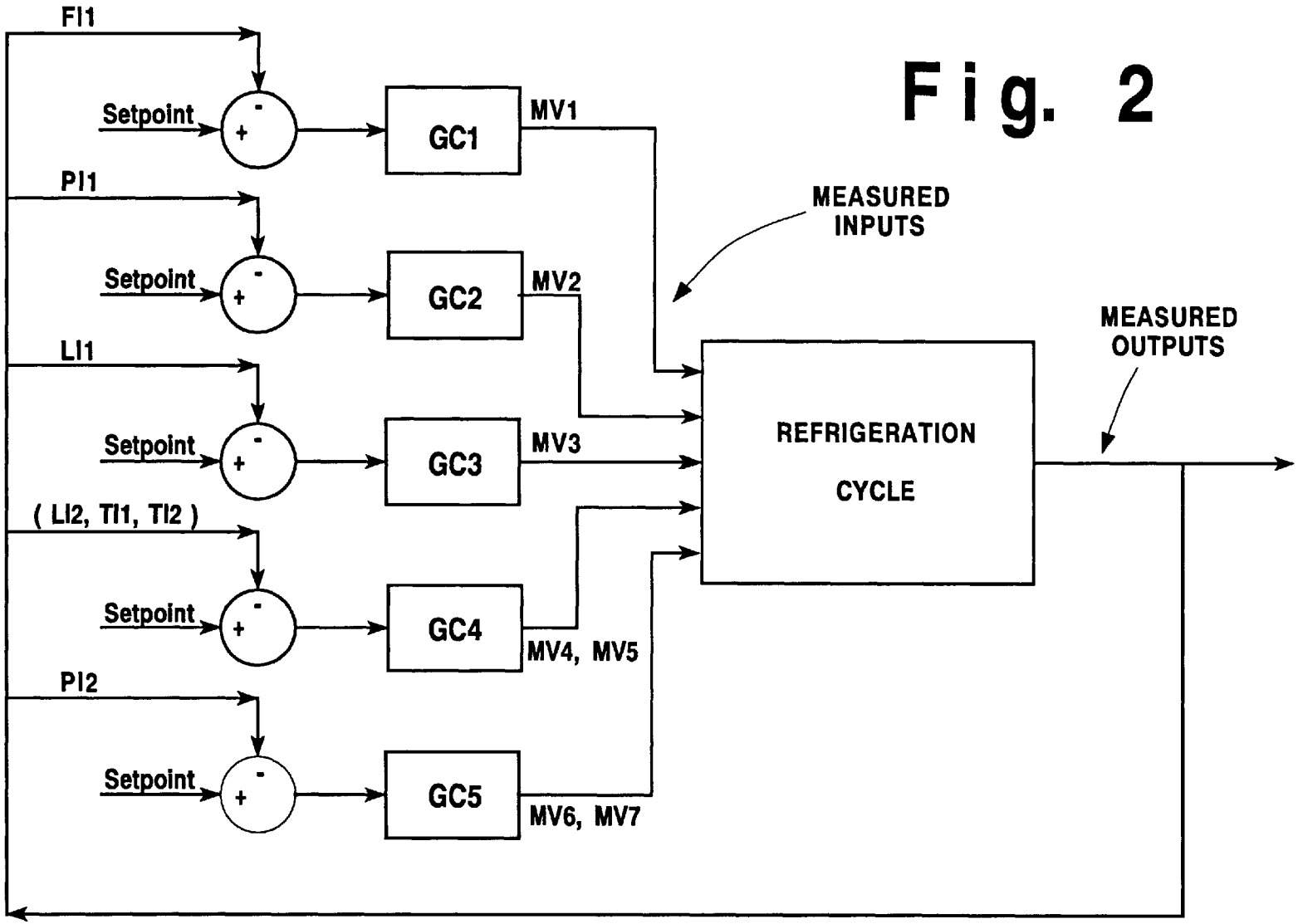
FIG. 2 is a logic diagram for the preferred control system illustrated in FIG. 1.

The invention will be described in detail with reference to the Drawings. In FIGS. 1 and 2 the following variables are identified as indicated below.

FI1—Product Fluid Production Rate

PI1—Cold Refrigerant Fluid Pressure

LI1—Product Fluid Liquid Level

LI2—Liquid Level in Intermediate Separator

TI1—Temperature in Intermediate Separator

TI2—Temperature of Refrigerant Fluid Downstream of Aftercooler

PI2—Pressure of Refrigerant Fluid Discharged From the Compressor

MV1—Compressor Control Such As Slide Valve Position or Guide Vane Position

MV2—Position of Second Joule-Thomson Valve

MV3—Position of Product Valve

MV4—Position of First Joule-Thomson Valve

MV5—Position of Cooling Fluid Input Valve

MV6—Position of Surge Tank Inlet Valve

MV7—Position of Surge Tank Outlet Valve

Multicomponent refrigerant fluid 1, which is preferably a multicomponent refrigerant fluid disclosed in U.S. Pat. No. 6,076,372—Acharya et al., is compressed by passage through compressor 2, which may be a single stage or multi-stage compressor, to a pressure generally within the range of from 14.7 to 300 pounds per square inch absolute to form pressurized refrigerant fluid 3. The pressurized refrigerant fluid is cooled and partially condensed in aftercooler 4 by indirect heat exchange with cooling fluid 5 provided through cooling fluid input valve 6. Cooled refrigerant fluid 7 is fed to separator A wherein the liquid and vapor are separated for the purpose of being evenly distributed into the passages of the downstream heat exchanger.

Liquid 8 and vapor 9 from separator A are combined to form stream 10 and fed to initial stage 11 of a multistage heat exchanger where the combined stream is cooled against returning low pressure refrigerant fluid. In the embodiment of the invention illustrated in FIG. 1, the multistage heat exchanger comprises initial or warm stage 11 and final or cold stage 21 along with one intermediate stage 17. As the high pressure refrigerant is cooled more of the vapor condenses. The mixed-phase high pressure refrigerant fluid 12 is passed into an intermediate separator B, which has a vapor exit and a liquid exit, where the vapor and liquid phases are separated and fed to the different refrigerant loops. The liquid 13, comprising mostly heavy refrigerant, is passed out from the liquid exit and fed to the warm loop, and the vapor 14, comprising mostly light refrigerant, is passed out from the vapor exit and fed to the cold loop. Liquid refrigerant fluid 13 is flashed to a low pressure across first Joule-Thomson valve 15. The resulting expansion cools the stream before it is introduced as stream 16 to intermediate stage 17. Vapor refrigerant fluid 14 from separator B is also fed to intermediate stage 17. Both refrigerant fluid streams 16 and 14 exchange heat with each other and with the returning low pressure refrigerant resulting in refrigerant streams 18 and 19 respectively.

High pressure refrigerant stream 19 is fed to phase separator D wherein any refrigerant that condensed in heat exchanger 17 is separated from vapor. The two phases are then recombined to form stream 20 which is passed to cold or final stage 21. In final stage 21 the high pressure refrigerant stream is cooled by indirect heat exchange with returning low pressure refrigerant. Downstream of final stage 21 the high pressure refrigerant stream is flashed to a low pressure across second Joule-Thomson valve 22 whereby significant cooling results. Resulting cooled and generally partially condensed refrigerant fluid 23 is passed to phase separator E wherein the liquid is separated from vapor to ensure even distribution in the subsequent heat exchange. The liquid 24 and vapor 25 from separator E are recombined to form stream 26 which is passed to final stage 21 to provide refrigeration for the refrigeration of the product fluid.

Product fluid 27 is provided to the multistage heat exchanger wherein it is cooled and may be totally or partially liquefied by indirect heat exchange with the refrigerant fluid. And suitable fluid may be used as the product fluid in the practice of this invention. Preferably the product is an industrial gas among which one can name oxygen, argon and nitrogen. Gas mixtures can also be employed as the product fluid. Typically the product fluid is cooled to a temperature within the range of from 70K to 150K. Cooled product fluid 28 is passed through product valve 29 and recovered as refrigerated product 30.

Low pressure refrigerant fluid 31 emerging from final stage 21 is recombined with refrigerant fluid 37 from phase separator C, which received refrigerant fluid stream 18 from intermediate stage 17, to form low pressure returning refrigerant stream 33 which passes through intermediate stage 17 and initial stage 11 for providing cooling to both the high pressure refrigerant stream and to the product fluid stream prior to returning to compressor 2 as stream 1.

A surge tank 34 is tied into the process to serve two purposes. The first purpose is to provide surge capacity for the compressor train. The second purpose is to serve as hold-up capacity for refrigerant during turn-down or shutdown. Surge tank inlet valve 35 can be opened to allow material to flow from the compressor discharge in line 37 to surge tank 34. This reduces the circulating mass in the cycle. Surge tank outlet valve 31 can be opened to allow material to flow from the surge tank in line 38 to the return stream for passage to the compressor suction.

There are several process design variations which may be used in the practice of the invention including but not limited to:

The compressor could be any type suitable to the compression of the mixed refrigerant (e.g. oil flooded screw, centrifugal, etc.);

The compressor could be single or multi-staged and can comprise a single train or multiple trains in parallel;

The aftercooler could be water-cooled, could use chilled water, or could be a separate refrigeration cycle;

Two or more of the heat exchanger stages could be combined into a single block;

The re-combining of material in the warm and cold loops could take place in one of the separators;

There could be additional minor process streams to facilitate the transfer of liquid or vapor from one point to another; and Small compressors and pumps could be added to facilitate the transfer of liquid or vapor from one point to another.

To better gauge the relative dynamic merits of potential control structures, a linear quadratic regulator problem was solved for each structure to determine sets of optimal controller tunings with respect to the following objective function:

$$J = \int_{t=0}^{T} (y^T Q y + u^T R u) dt$$

where y represents the vector of controlled variables and u represents the vector of manipulated variables. The outputs y were scaled according to their allowable ranges and the inputs were scaled according to their spans. For simplicity Q and R were taken to be identity matrices. The Q and R matrices designate the relative weighting of deviations in controlled and manipulated variables. The use of identity matrices sets the relative importance of each variable to be equal. T was selected to be ½ hour. Initial states were taken to lie on the unit sphere. To provide a baseline for comparison, the problem was solved first for a fully centralized controller. The partially de-centralized control structure was significantly more simple than the fully centralized structure and did not sacrifice much in the way of dynamic performance. This control system of this invention is illustrated in FIG. 2.

In the control structure of this invention there are five independent controllers. The first controller GC1 monitors the production rate, compares it to the desired production rate, and adjusts the compressor operation accordingly (the actuator type is dependent on the type of compressor employed). The second controller GC2 manipulates the second or cold Joule-Thomson valve position to maintain the cold-end pressure at its setpoint. A third controller GC3 uses the product valve to control the product liquid level. Controller GC4 adjusts the first Joule-Thomson valve position and the cooling fluid valve position simultaneously to control the liquid level in separator B, the temperature of separator B, and the temperature of refrigerant fluid leaving the aftercooler. The fifth controller GC5 monitors the compressor discharge pressure and manipulates the surge tank inlet and outlet valve positions based upon the desired value of the discharge pressure.

To better understand the merits of the invention, one can compare the dynamic performance of several control structures and weigh the dynamic performance against simplicity. Table 1 lists the performance, as measured by J, versus the simplicity, as measured by the minimum number of tuning parameters involved, for several control systems. The baseline control system is the one that is fully centralized (all manipulated variables are used to regulate all controlled variables).

As can be observed from Table 1 the control structure of the invention offers an excellent trade-off between performance and simplicity. In moving from the fully centralized control structure to the invention, the performance is only degraded by 14% while the number of tuning parameters is decreased by more than three-fold. Further simplifications to the control system result in performance sacrifices greater than 44% and only simplify the system an additional 33%.

TABLE 1

Performance and Complexity of Control Alternatives

| Structure | Performance (J) | Complexity (# of Tuning Params) |
|---|---|---|
| Fully Centralized | 20.48 | 30 |
| Invention | 23.35 | 9 |
| decentralized | 44.81 | 6 |

There are many possible ways to implement each of the five controllers that are involved in the invention. The most straightforward way to implement the controllers that have single inputs and single outputs is as PI type controllers. This is because the algorithms for PI control are well established, the software needed to implement them is readily available, and tuning methods are simple and well known.

The fourth controller, which controls the liquid level in separator B, the temperature of separator B, and the temperature of the refrigerant leaving the aftercooler using the first JT valve position and the aftercooler input valve position can be any form of multi-variable controller or could be single input, single output controllers that interact via overrides.

Controller GC5 can also take advantage of available multi-variable control algorithms, but the most straightforward implementation of this controller is to use two solenoids. One solenoid opens the surge tank inlet valve when the compressor discharge pressure exceeds its target value by a few pounds per square inch. The other solenoid opens the surge tank outlet valve when the compressor discharge pressure is lower than a few pounds per square inch below its target value.

Although the invention has been described in detail with reference to a certain particularly preferred embodiment, those skilled in the art will recognize that there are other embodiments of the invention within the spirit and scope of the claims.

What is claimed is:

1. Apparatus for producing refrigerated product comprising:

(A) a compressor, a surge tank, means for passing refrigerant fluid from the compressor to the surge tank said means including a surge tank inlet valve, and means for passing refrigerant fluid from the surge tank to the compressor said means including a surge tank outlet valve;

(B) a multistage heat exchanger having an initial stage and a final stage, and means for passing refrigerant fluid from the compressor to the heat exchanger said means including an aftercooler having a cooling fluid input valve;

(C) a phase separator having a vapor exit and a liquid exit, means for passing refrigerant fluid from the initial stage of the heat exchanger to the phase separator, and means for passing refrigerant fluid from the liquid exit of the phase separator to the compressor said means including a first Joule-Thomson valve;

(D) means for passing refrigerant fluid from the vapor exit of the phase separator to a second Joule-Thomson valve, from the second Joule-Thomson valve to the final stage of the heat exchanger, and from the final stage of the heat exchanger to the compressor;

(E) means for passing product fluid to the multistage heat exchanger, and means for recovering refrigerated product from the multistage heat exchanger said means including a product valve;

(F) a first controller for regulating the product fluid production rate, said first controller manipulating the compressor;

(G) a second controller for regulating the pressure of refrigerant fluid passed to the compressor, said second controller adjusting the position of the second Joule-Thomson valve;

(H) a third controller for regulating product fluid liquid level, said third controller manipulating the product valve;

(I) a fourth controller for regulating the temperature of the refrigerant fluid downstream of the aftercooler, the temperature of the refrigerant fluid upstream of the first Joule-Thomson valve and the liquid level in the separator, said fourth controller controlling the position of the cooling fluid input valve and also adjusting the position of the first Joule-Thomson valve; and (J) a fifth controller for regulating the pressure of refrigerant fluid discharged from the compressor, said fifth controller adjusting the position of the surge tank inlet valve and also adjusting the position of the surge tank outlet valve.

2. The apparatus of claim 1 wherein the multistage heat exchanger additionally comprises an intermediate stage.

3. The apparatus of claim 2 wherein the means for passing refrigerant fluid from the liquid exit of the phase separator to the compressor includes the intermediate stage of the multistage heat exchanger.

4. The apparatus of claim 1 wherein the means for passing refrigerant fluid from the vapor exit of the phase separator to the second Joule-Thomson valve includes the final stage of the multistage heat exchanger.

5. The apparatus of claim 2 wherein the means for passing refrigerant fluid from the vapor exit of the phase separator to the second Joule-Thomson valve includes the intermediate stage of the multistage heat exchanger.

6. The apparatus of claim 2 wherein the means for passing refrigerant fluid from the vapor exit of the phase separator to the second Joule-Thomson valve includes both the intermediate stage and the final stage of the multistage heat exchanger.

7. The apparatus of claim 1 wherein the means for passing product fluid to the multistage heat exchanger passes the product fluid to the initial stage of the multistage heat exchanger.

* * * * *